US007661170B2

(12) United States Patent
Goode et al.

(10) Patent No.: US 7,661,170 B2
(45) Date of Patent: Feb. 16, 2010

(54) SYSTEMS AND METHODS FOR PROVIDING A CUSTOMIZED LOWER EXTREMITY PRODUCT

(75) Inventors: David Goode, Huntsville, UT (US); Iain Hueton, Olden, UT (US)

(73) Assignee: D2 Investments, LLC, Ogden, UT (US)

( * ) Notice: Subject to any disclaimer, the term of this patent is extended or adjusted under 35 U.S.C. 154(b) by 831 days.

(21) Appl. No.: 11/324,437

(22) Filed: Jan. 3, 2006

(65) Prior Publication Data

US 2007/0156362 A1 Jul. 5, 2007

(51) Int. Cl.
*A43B 5/00* (2006.01)

(52) U.S. Cl. ..... 12/1 R; 12/142 N; 36/117.1

(58) Field of Classification Search ..... 12/146 M, 12/142 N, 1 R; 36/117.1, 88
See application file for complete search history.

(56) References Cited

U.S. PATENT DOCUMENTS 5,206,804 A * 4/1993 Thies et al. ..... 705/27
5,216,594 A * 6/1993 White et al. ..... 705/28
5,237,520 A * 8/1993 White ..... 382/154
5,339,252 A * 8/1994 White et al. ..... 700/98
5,687,467 A * 11/1997 Bergmann et al. ..... 29/407.05
5,790,256 A * 8/1998 Brown et al. ..... 356/613
6,006,412 A * 12/1999 Bergmann et al. ..... 29/407.04
6,131,311 A * 10/2000 Brown et al. ..... 36/43
6,141,889 A * 11/2000 Baum ..... 36/140
6,231,527 B1 * 5/2001 Sol ..... 600/595
6,804,571 B2 * 10/2004 Fullen et al. ..... 700/118
7,346,418 B2 * 3/2008 Lowe ..... 700/118
7,392,559 B2 * 7/2008 Peterson ..... 12/1 R
2002/0138923 A1 * 10/2002 Shaffeeullah ..... 12/142 N
2005/0071935 A1 * 4/2005 Shah et al. ..... 12/146 L
2006/0070260 A1 * 4/2006 Cavanagh et al. ..... 36/44
2006/0143839 A1 * 7/2006 Fromme ..... 12/142 R
2007/0142955 A1 * 6/2007 Lin et al. ..... 700/117
2008/0147219 A1 * 6/2008 Jones et al. ..... 700/95

* cited by examiner

*Primary Examiner*—Marie Patterson
(74) *Attorney, Agent, or Firm*—Trent H. Baker; Baker & Associates PLLC

(57) ABSTRACT

The present invention relates to the production of lower extremity supportive products, including boot, shoes, sandals, leg braces, etc. One embodiment of the present invention relates to a method for providing a three-dimensionally customized lower extremity product. The method includes measuring and recording data related to a three-dimensional representation of a customer's lower extremities in an activity-specific optimal stance. The three-dimensional representation includes specific anatomical position information including extensions, flexions, rotations, inversions, eversions, etc. The three-dimensional representation also includes surface information including foot shape, ankle shape, sole shape, etc. The measurement and recordation is performed at a convenient location such as in close proximity to the customer's residence or at an airport terminal. The customized lower extremity product is then manufactured at an independent location. The manufactured customized lower extremity product is customized according to the data so as to support the customer's lower extremity in the activity-specific optimal stance. In addition, the customized lower extremity product may be delivered to a location that facilitates customer pickup.

23 Claims, 4 Drawing Sheets

SYSTEMS AND METHODS FOR PROVIDING A CUSTOMIZED LOWER EXTREMITY PRODUCT

FIELD OF THE INVENTION

The present invention relates to the production of lower extremity supportive products including boots, shoes, sandals, leg braces, etc. In particular, the invention relates to systems and methods for providing a customized lower extremity product.

BACKGROUND OF THE INVENTION

Participants in many activities utilize lower extremity supportive products to assist or improve their performance. In some activities, the products are also necessary for coupling the user in some manner to a required sports apparatus. For example, it is necessary for skiers to use some form of boots to couple their lower extremities to skis. A skier's boot both provides support and encourages the skier to position their lower extremity in a particular position that is designed to maximize performance. Boots are generally optimized according to a single foot mold. Additional sized boots are generally created by enlarging or reducing the size of the original boot by a standardized amount. However, participants have a wide range of foot shapes, sizes, flexibilities, and performance abilities. Therefore, it is unlikely that a boot that has been sized up or down a specific amount from a standardized mold will match the unique characteristics of a particular participant's foot. This guaranteed mismatch results in a decrease in performance and the possibility of discomfort or pain.

Conventional lower extremity customization systems attempt to conform a lower extremity product that has been sized up or down a specific amount from a standardized mold. These systems include adding pads, applying force to pressure points, removing materials, etc. These after-market customization or "boot fitting" techniques are unreliable and may result in damaging the integrity of the boot. In addition, these techniques are generally done on site. Therefore, a boot fitter in one location may make radically different adjustments than a boot fitter at an independent location.

A second type of customization process involves the utilization of a liner or injection of a foam material that is conformed to a user's unique lower extremity characteristics. The process of conforming the liner or liner substance may include heating or injection while a user positions their lower extremity in the product. These systems may help accommodate a standardized lower extremity product to a specific participant's lower extremity dimensions, but they are limited. For example, a heat-treated liner is unlikely to relieve foot pressure for a person with severe foot eversion. In addition, these systems are ureliable and inconvenient. A heat-treated foam liner will deform to provide less support in the desired position over time. Likewise, an injected foam system must be reapplied after each time that a user removes the boots. In addition to the other limitations, these after-market systems still fail to provide the same level of performance to a participant that would be afforded if the participant's lower extremity matched the original mold used to create the product.

Other customization processes are designed to manufacture lower extremity products that specifically match the characteristics of the sole or bottom surface of an individual's foot. These processes involve either two-dimensionally tracing or three-dimensionally mapping the sole of the foot. However, the remainder of the lower extremity product is still made according to a standardized mold or according to a standardized format. Essentially these processes involve manufacturing customized footbeds or orthodics which are incorporated into a standardized lower extremity product such as a boot. The performance and comfort characteristics of a lower extremity product are not limited to the region in which the sole of a user's foot contacts the product. Therefore, these customization processes also fails to provide a level of customization necessary to maximize performance and accommodate the individual lower-extremity characteristics that affect comfort.

All of the existing customization systems fail to produce a truly customized product in a cost-efficient manner. Therefore, there is a need in the industry for a method of providing a customized lower extremity product that is truly customized to the unique three-dimensional characteristics of a customer's lower extremities for use in a particular activity.

SUMMARY

The present invention relates to the production of lower extremity supportive products, including boot, shoes, sandals, leg braces, etc. One embodiment of the present invention relates to a method for providing a three-dimensionally customized lower extremity product. The method includes measuring and recording data related to a three-dimensional representation of a customer's lower extremities in an activity-specific optimal stance. The three-dimensional representation includes specific anatomical position information including extensions, flexions, rotations, inversions, eversions, etc. The three-dimensional representation also includes surface information including foot shape, ankle shape, sole shape, etc. The measurement and recordation is performed at a convenient location such as in close proximity to the customer's residence or at an airport terminal. The customized lower extremity product is then manufactured at an independent location. The manufactured customized lower extremity product is customized according to the data so as to support the customer's lower extremity in the activity-specific optimal stance. In addition, the customized lower extremity product may be delivered to a location that facilitates customer pickup.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE INVENTION

The present invention relates to the production of lower extremity supportive products, including boot, shoes, sandals, leg braces, etc. One embodiment of the present invention relates to a method for providing a three-dimensionally customized lower extremity product. The method includes measuring and recording data related to a three-dimensional representation of a customer's lower extremities in an activity-specific optimal stance. The three-dimensional representation includes specific anatomical position information including extensions, flexions, rotations, inversions, eversions, etc.

The three-dimensional representation also includes surface information including foot shape, ankle shape, sole shape, etc. The measurement and recordation is performed at a convenient location such as in close proximity to the customer's residence or at an airport terminal. The customized lower extremity product is then manufactured at an independent location. The manufactured customized lower extremity product is customized according to the data so as to support the customer's lower extremity in the activity-specific optimal stance. In addition, the customized lower extremity product may be delivered to a location that facilitates customer pickup. Also, while embodiments of the present invention are directed at lower extremity products, it will be appreciated that the teachings of the present invention could be applied to other areas.

The Following Terms are Defined:

Activity-specific optimal stance—an individual's three-dimensional body position that is optimized for a particular activity. An activity-specific optimal stance includes anatomical positioning such as back flexion/extension, arm flexion/extension, leg flexion/extension, foot dorsiflexion/plantarflexion, leg abduction/adduction, leg medial/lateral rotation, leg circumduction, foot eversion/inversion, shoulder elevation/depression, etc.

Three-dimensional representation—a representation of the shape and texture of all of the surfaces contained within a particular region. For example, a lower extremity three-dimensional representation would include the shape and texture of the lower extremities including but not limited to the upper and lower leg, the ankle, the foot, the sole, etc.

Lower extremity—a lower region of the human body including but not limited to hips, upper and lower legs, knees, calves, feet, toes, etc.

Globally cost-efficient manufacturing location—a location that provides manufacturing at a price that is globally competitive. For example, shoes are often manufactured in China because of its globally competitive price for most products.

The following disclosure of the present invention is grouped into three subheadings, namely "Operating Environment" and "Producing a Customized Product". The utilization of the subheadings is for convenience of the reader only and is not to be construed as limiting in any sense.

Operating Enviroment

Figure 1:
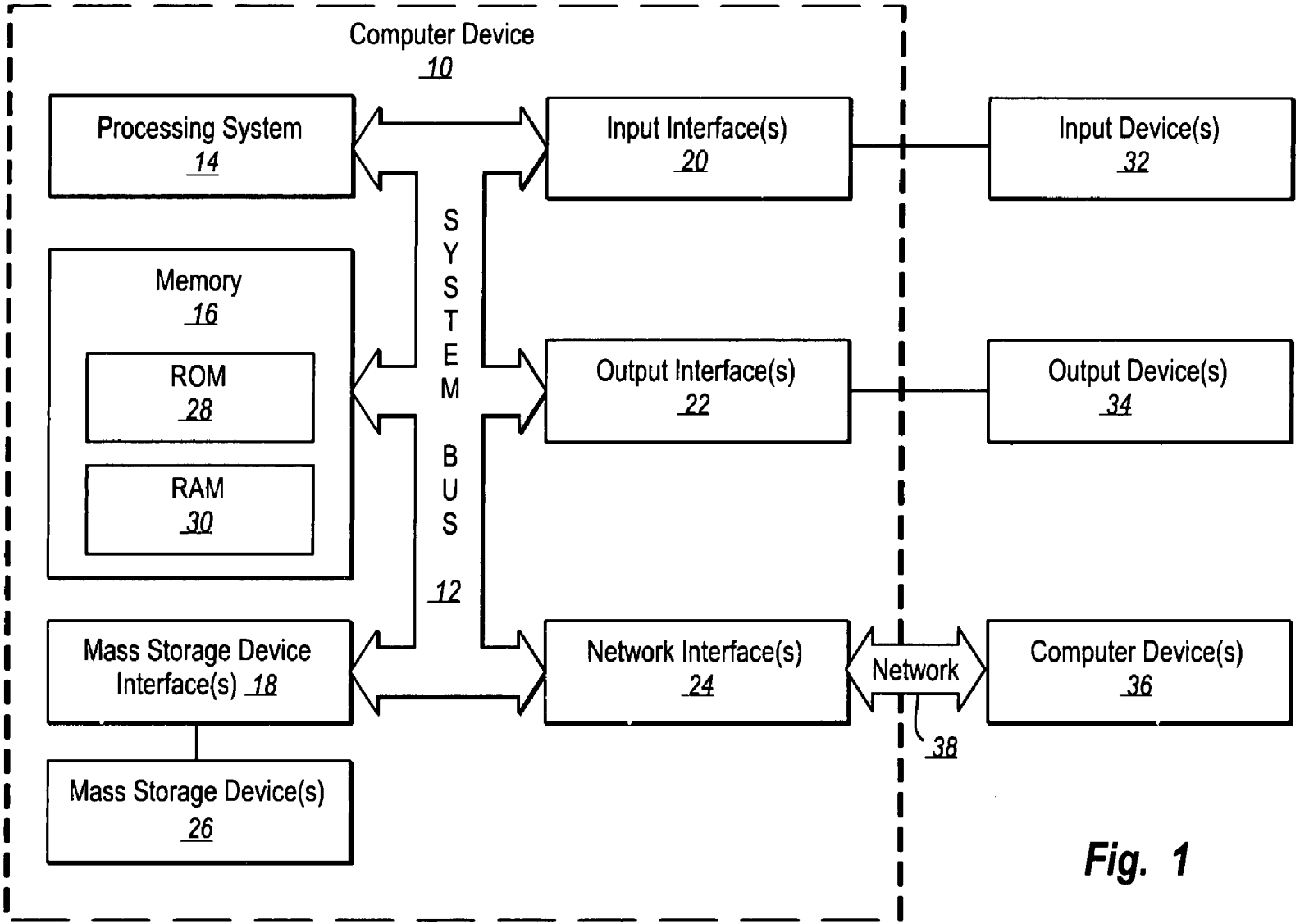
FIG. 1 illustrates a flow chart of a suitable computer operating environment for embodiments of the present invention.

FIG. 1 and the corresponding discussion are intended to provide a general description of a suitable operating environment in which the invention may be implemented. One skilled in the art will appreciate that the invention may be practiced by one or more computing devices and in a variety of system configurations, including in a networked configuration. Alternatively, the invention may also be practiced in whole or in part manually following the same procedures.

Embodiments of the present invention embrace one or more computer readable media, wherein each medium may be configured to include or includes thereon data or computer executable instructions for manipulating data. The computer executable instructions include data structures, objects, programs, routines, or other program modules that may be accessed by a processing system, such as one associated with a general-purpose computer capable of performing various different functions or one associated with a special-purpose computer capable of performing a limited number of functions. Computer executable instructions cause the processing system to perform a particular function or group of functions and are examples of program code means for implementing steps for methods disclosed herein. Furthermore, a particular sequence of the executable instructions provides an example of corresponding acts that may be used to implement such steps. Examples of computer readable media include random-access memory ("RAM"), read-only memory ("ROM"), programmable read-only memory ("PROM"), erasable programmable read-only memory ("EPROM"), electrically erasable programmable read-only memory ("EEPROM"), compact disk read-only memory ("CD-ROM"), or any other device or component that is capable of providing data or executable instructions that may be accessed by a processing system.

With reference to FIG. 1, a representative system for implementing the invention includes computer device 10, which may be a general-purpose or special-purpose computer. For example, computer device 10 may be a personal computer, a notebook computer, a personal digital assistant ("PDA") or other hand-held device, a workstation, a minicomputer, a mainframe, a supercomputer, a multi-processor system, a network computer, a processor-based consumer electronic device, or the like.

Computer device 10 includes system bus 12, which may be configured to connect various components thereof and enables data to be exchanged between two or more components. System bus 12 may include one of a variety of bus structures including a memory bus or memory controller, a peripheral bus, or a local bus that uses any of a variety of bus architectures. Typical components connected by system bus 12 include processing system 14 and memory 16. Other components may include one or more mass storage device interfaces 18, input interfaces 20, output interfaces 22, and/or network interfaces 24, each of which will be discussed below.

Processing system 14 includes one or more processors, such as a central processor and optionally one or more other processors designed to perform a particular function or task. It is typically processing system 14 that executes the instructions provided on computer readable media, such as on memory 16, a magnetic hard disk, a removable magnetic disk, a magnetic cassette, an optical disk, or from a communication connection, which may also be viewed as a computer readable medium.

Memory 16 includes one or more computer readable media that may be configured to include or includes thereon data or instructions for manipulating data, and may be accessed by processing system 14 through system bus 12. Memory 16 may include, for example, ROM 28, used to permanently store information, and/or RAM 30, used to temporarily store information. ROM 28 may include a basic input/output system ("BIOS") having one or more routines that are used to establish communication, such as during start-up of computer device 10. RAM 30 may include one or more program modules, such as one or more operating systems, application programs, and/or program data.

One or more mass storage device interfaces 18 may be used to connect one or more mass storage devices 26 to system bus 12. The mass storage devices 26 may be incorporated into or may be peripheral to computer device 10 and allow computer device 10 to retain large amounts of data. Optionally, one or more of the mass storage devices 26 may be removable from computer device 10. Examples of mass storage devices include hard disk drives, magnetic disk drives, tape drives and optical disk drives. A mass storage device 26 may read from and/or write to a magnetic hard disk, a removable magnetic disk, a magnetic cassette, an optical disk, or another computer readable medium. Mass storage devices 26 and their corresponding computer readable media provide nonvolatile storage of data and/or executable instructions that may include one or more program modules such as an operating system, one or more application programs, other program modules, or program data. Such executable instructions are examples of program code means for implementing steps for methods disclosed herein.

One or more input interfaces 20 may be employed to enable a user to enter data and/or instructions to computer device 10 through one or more corresponding input devices 32. Examples of such input devices include a keyboard and alternate input devices, such as a mouse, trackball, light pen, stylus, or other pointing device, a microphone, a joystick, a game pad, a satellite dish, a scanner, a camcorder, a digital camera, and the like. Similarly, examples of input interfaces 20 that may be used to connect the input devices 32 to the system bus 12 include a serial port, a parallel port, a game port, a universal serial bus ("USB"), a firewire (IEEE 1394), or another interface.

One or more output interfaces 22 may be employed to connect one or more corresponding output devices 34 to system bus 12. Examples of output devices include a monitor or display screen, a speaker, a printer, and the like. A particular output device 34 may be integrated with or peripheral to computer device 10. Examples of output interfaces include a video adapter, an audio adapter, a parallel port, and the like.

One or more network interfaces 24 enable computer device 10 to exchange information with one or more other local or remote computer devices, illustrated as computer devices 36, via a network 38 that may include hardwired and/or wireless links. Examples of network interfaces include a network adapter for connection to a local area network ("LAN") or a modem, wireless link, or other adapter for connection to a wide area network ("WAN"), such as the Internet. The network interface 24 may be incorporated with or peripheral to computer device 10. In a networked system, accessible program modules or portions thereof may be stored in a remote memory storage device. Furthermore, in a networked system computer device 10 may participate in a distributed computing environment, where functions or tasks are performed by a plurality of networked computer devices.

Producing a Customized Product

Figure 2:
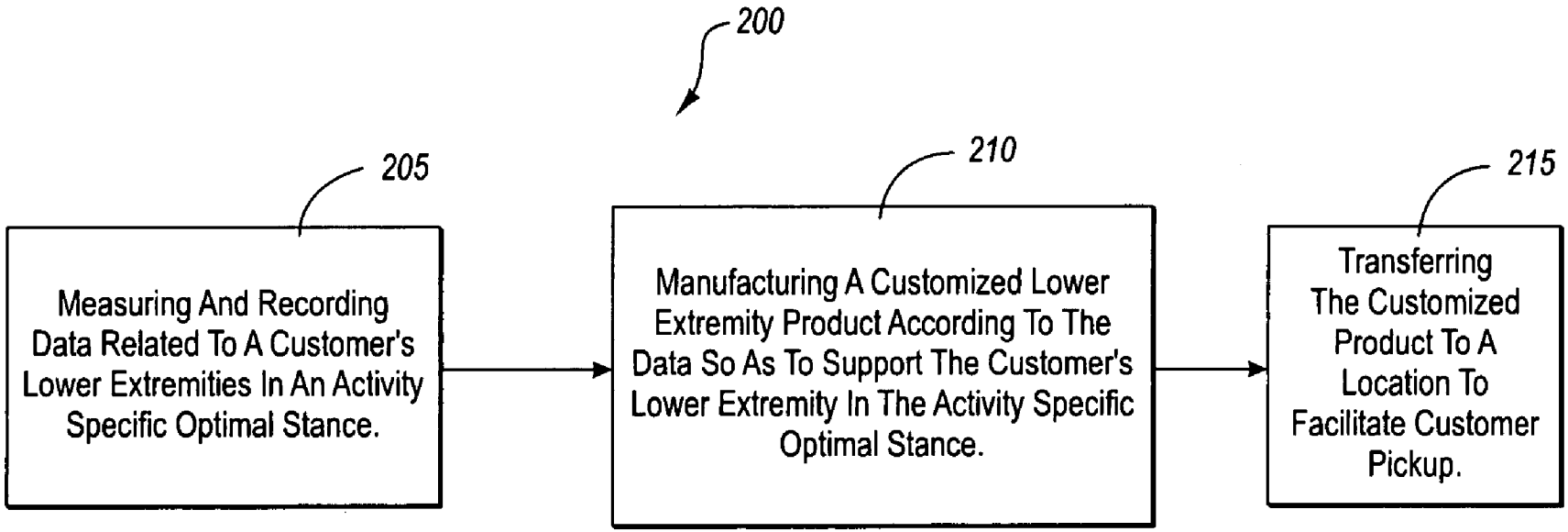
FIG. 2 illustrates a flow chart of one embodiment of the present invention for providing a three-dimensionally customized lower extremity product.

Reference is next made to FIG. 2, which illustrates a flow chart of one embodiment of the present invention of a method for providing a three-dimensionally customized lower extremity product, designated generally at 200. The customized lower extremity product is specifically designed to optimize a user's performance in a particular activity. Lower extremity products generally support and bind participants to various sports apparatus. In part, a user's performance in large part depends on their body position. Therefore, a lower extremity product can optimize a user's performance by supporting a user in a particular stance that is consistent with their optimal performance of a particular activity. However, the unique body size, contours, limitations, and imbalances of an individual are not reflected in the conventional shoe sizing system associated with most lower extremity activity-specific products. It is not accurate to assume that since two individuals have relatively the same length of feet, that the remainder of their lower extremities will be the same. The method described below is directed towards the production of a true customized lower extremity product.

Initially, data related to a three-dimensional representation of a person in an activity-specific optimal stance, is measured and recorded, act 205. The activity-specific optimal stance is a unique total body position that maximizes a particular user's performance and/or minimizes their chance of injury while maintaining optimal comfort. For example, a generic activity-specific optimal stance would involve a particular amount of knee bend/articulation to improve balance and allow for quick reaction. However, an individual with severe knee injuries may be forced to assume a stance that has less knee articulation. As will be described in more detail with reference to FIG. 4, the act of measuring and recording 205 may further include positioning a user in the activity-specific optimal stance 207 and/or scanning their lower extremities to create a set of data 209. The act of positioning an individual in an activity-specific optimal stance 207 requires a second individual or apparatus to guide the individual toward a stance that is know to be optimal for a particular activity. The act of scanning the individual to create a set of data 207 includes generating data corresponding to a three-dimensional representation of the individual's lower extremities in the activity-specific optimal stance. A three-dimensional representation includes relative position, surface contour, shape, volume, etc. The three-dimensional representation also includes the lower surface of the foot or sole. Therefore, it may be necessary to combine information from a variety of measurement, scanning and imaging sources to produce a set of data that accurately represents the lower extremities of the individual. For example, a three-dimensional imaging scanner, a foot/sole pressure scanner, a plurality of images, etc. It should be noted that many conventional three-dimensional molding techniques cannot be used because they do not allow for an individual to assume an activity-specific optimal stance while the mold is being made.

The customized lower extremity product is then manufactured according to the data at an independent location, act 210. The lower extremity product may be manufactured according to any well-known lower extremity product manufacturing process including but not limited to injection molding. The data is transferred from the location at which the act of measurement and recording 205 is performed to the manufacturing location. Well known data transfer techniques may be used to transfer the recorded data to a particular manufacturing facility. For example, the Internet, FTP, mail, or any other data transfer system may be utilized and remain consistent with the present invention. Because of the distributed architecture of this method, it is possible to select a manufacturing facility that can manufacture the product at a globally efficient price. For example, China is a preferred manufacturing location for many products because of its inexpensive labor. Alternatively, the product may be manufactured on-site if sufficient resources are available.

The customized lower extremity product is then transferred to facilitate customer pickup, act 215. After the act of manufacturing 210, the product may be shipped to a particular location that is convenient with customer pickup. For example, the customized product may be shipped to an affiliated retail outlet that is located in close proximity to the customer. Alternatively, the customized product could be shipped to a location to coincide with a particular customer's travel schedule. For example, if a customer is flying to a particular location, the customized product may be shipped to an airport to facilitate efficient pickup. The transfer of the product may include shipping and/or hand delivery. Additional acts may be included to allow a customer to specify a location that is convenient for pickup.

Figure 3:
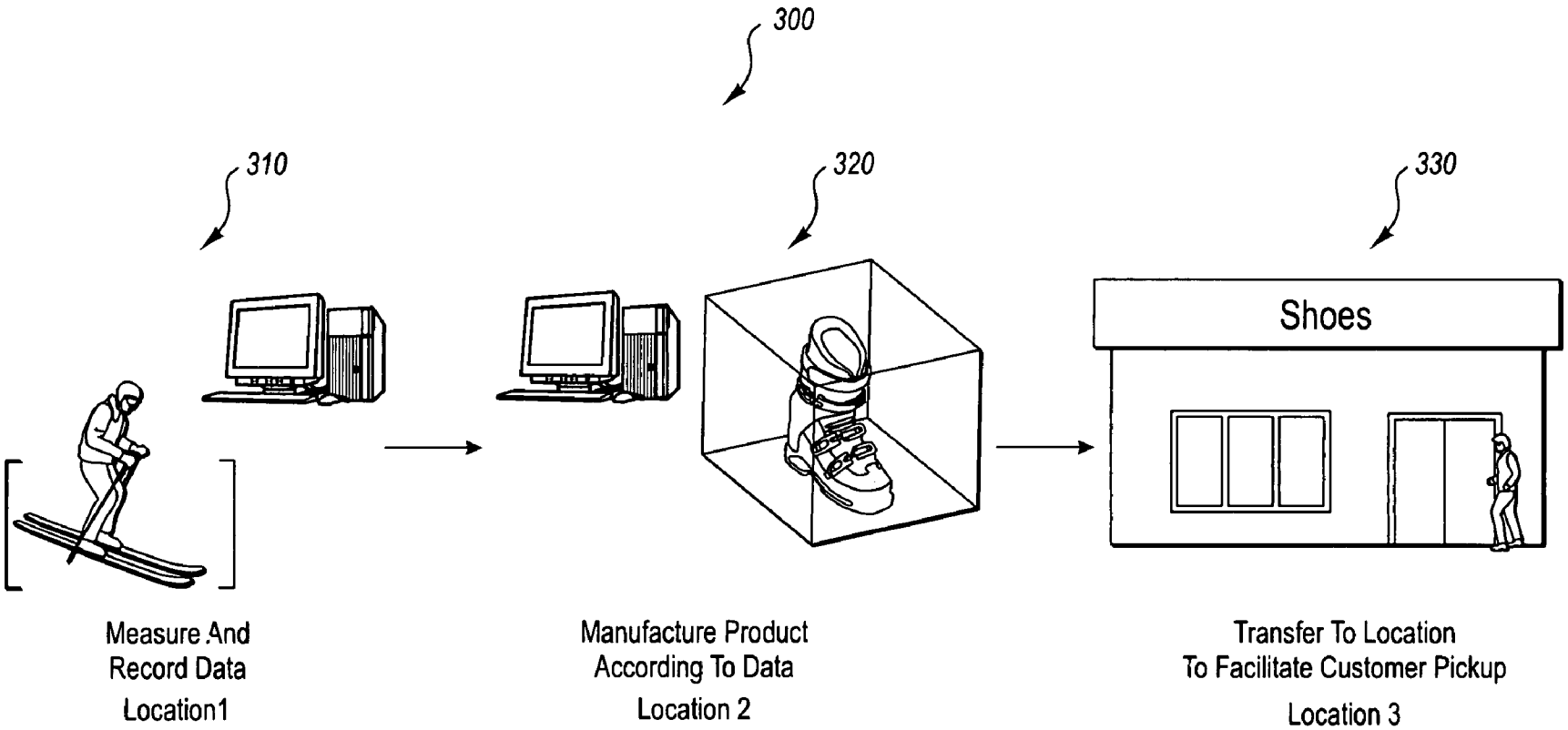
FIG. 3 illustrates a flow chart of an alternative embodiment of the present invention incorporating geographical information.

Reference is next made to FIG. 3, which illustrates a flow chart of an alternative embodiment of a method for providing a three-dimensionally customized lower extremity product, designated generally at 300. The method 300 illustrates a similar method to the one illustrated in FIG. 1 but includes additional geographical and exemplary visual representations of the included acts. As described above, data is initially measured and recorded of a customer in a particular activity-specific optimal stance, act 310. The illustration shows a customer in a conventional skiing stance being measured. Data is collected and stored on some form of readable medium such as a computer hard disk, CD, or paper. Various scanning or measurement devices may be directly coupled to the computer such that data is automatically recorded upon measurement. A technician or measurement specialist may be required to assist the individual towards an activity-specific optimal stance and initiate the measurement and recording system. As illustrated, the measurement and recording act is performed at location #1. Location #1 may be an affiliated retail outlet that is configured to measure and recording the data. Alternatively, location #1 may be located in close proximity to facilities in which the activity for which the activity-specific optimal stance is performed. For example, location #1 could be located at a ski resort to allow skiers to be measured and recorded in the activity-specific optimal stance. Alternatively, the act of measuring and recording data relating to the three-dimensional representation of the customer in the activity-specific optimal stance could be performed locally by a customer on themselves using readily available measurement devices. For example, an Internet interface could provide specific instructions to allow customers to accurately measure and input the data to be recorded at a remote location.

The data is then transferred to location #2 for manufacturing the customized product according to the data, act 320. The illustration shows a computer for receiving the data and some form of three-dimensional manufacturing device. Location #2 is generally independent of location #1 to allow for the most efficient manufacturing of the customized product. Many convention customization methods require that the customization be performed at the same location as where the measurements of the individual are performed. Location #2 may be a manufacturing facility which is equipped to receive data and directly implement the data into a manufacturing process that creates a product specifically tailored to the data. Various automated manufacturing processes may be utilized to effectuate an automatic process. Alternatively, a manual process may be used which incorporates the received data to manufacture the customized product. For example, the data may be used to create a plastic mold of an individual's lower extremity. A manufacturer may then use the mold to manually overlay materials to perfectly match the three-dimensional characteristics of the mold in the process of making the customized lower extremity product.

The customized lower extremity product is then transferred to location #3 to facilitate pickup, act 330. As illustrated, location #3 may be a retail outlet that is capable of receiving the customized product and delivering it to the correct customer. Various affilitate agreements may be incorporated so as to compensate the retail outlet a particular percentage of every sale. Additional acts may be incorporated to allow the customer to select the most efficient location for pickup. Alternatively, the customer's billing information could be used to automatically select the most convenient location for customer pickup based on proximity. Alternatively, location #3 may be the same as location #1 such that the customer is able to pickup their customized lower extremity product at the same location at which the measurement and recording of the data was performed.

Figure 4:
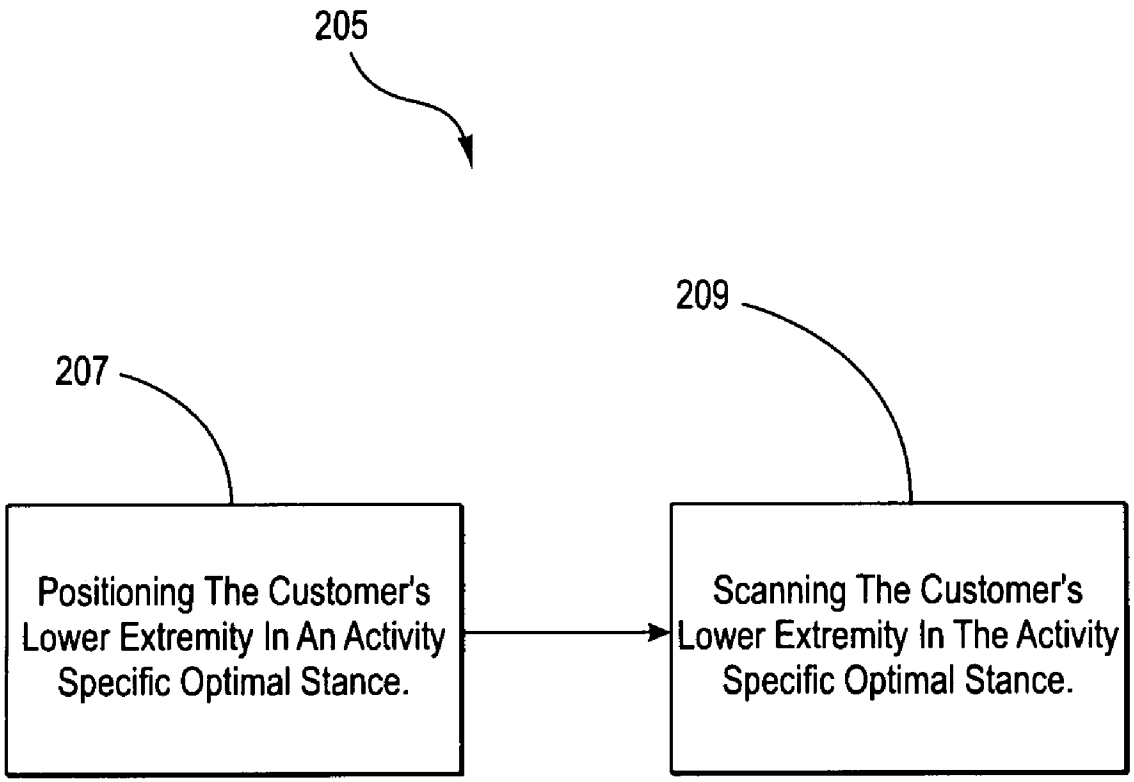
FIG. 4 illustrates a flow chart of one embodiment of act 205 illustrated in FIG. 2.

Reference is next made to FIG. 4, which illustrates a flow chart of one embodiment of act 205 illustrated in FIG. 2. The act of measuring and recording data relating to a three-dimensional representation of a customer's lower extremity in an activity-specific optimal stance may further include the acts of positioning 207 and scanning 209 the customer. Positioning a customer in an activity-specific optimal stance, act 207, may be performed either automatically via some form of device or manually. However, the positioning of the customer in the activity-specific optimal stance must be performed in a manner and location that allows for the three-dimensional scanning of their lower extremities. For example, simply positioning an individual on a flat surface will allow for many of the outer surfaces to be scanned but will not allow for the bottom of the foot/sole to be properly scanned. It may be necessary to perform multiple scans to create the data that accurately represents the three-dimensional representation of the customer's lower extremity in the activity-specific optimal stance. The act of scanning 209, may incorporate various manual and/or automatic scanning techniques. For example, a three-dimensional scanner may need to be supplemented with at least one manual measurements of critical dimensions to ensure accurate data representation of the customer's lower extremity in the activity-specific optimal stance.

In an alternative embodiment, locations #1, #2, and #3 may be disposed in close proximity to one another and remain consistent with the teachings of the present invention. For example, the locations could all be arranged in a single building or facility. This system would provide customers with on-site and/or real-time delivery of their customized lower extremity product. However, this configuration is not as economically efficient as transferring the data to an independent manufacturing facility that is globally cost-efficient to allow for manufacturing and then transferring the manufactured product back to a location for efficient pick up by the customer.

Various combinations and/or modifications to the described embodiments may be utilized and remain consistent with the present invention.

What is claimed is:

1. A method for providing a customized lower extremity product, comprising the acts of:

measuring and recording data related to a three-dimensional representation of a customer's lower extremities in an activity-specific optimal stance, at a first location;

manufacturing a customized lower extremity product at a second location, wherein the customized lower extremity product is customized according to the data so as to support the customer's lower extremity in the activity-specific optimal stance; and transferring the customized product to a third location to facilitate customer pickup.

2. The method of claim 1, wherein the customized lower extremity product is a boot.

3. The method of claim 2, wherein the activity-specific optimal stance is an optimal skiing stance.

4. The method of claim 1, wherein the three-dimensional representation includes anatomical three-dimensional position information of the lower extremity in the activity-specific optimal stance relative to a supportive surface.

5. The method of claim 1, wherein the act of measuring and recording data related to a three-dimensional representation of a customer's lower extremities in an activity-specific optimal stance, further includes:

positioning the customer's lower extremity in an activity-specific optimal stance; and scanning the customer's lower extremity in the activity-specific optimal stance to produce data relating to a three-dimensional representation of the customer's lower extremity in the activity-specific optimal stance.

6. The method of claim 5, wherein the act of positioning the customer's lower extremity in an activity-specific optimal stance includes determining an activity-specific optimal stance which maximizes performance in a particular activity and encouraging a customer's lower extremity into the determined activity-specific optimal stance.

7. The method of claim 5, wherein the three-dimensional representation includes a three-dimensional representation of the sole of the foot in the activity-specific optimal stance.

8. The method of claim 1, wherein the first location is in substantial proximity to the customer's residence.

9. The method of claim 1, wherein the first location is geographically independent of the second location.

10. The method of claim 1, wherein the first location, second location, and third location are located in substantial proximity to one another.

11. The method of claim 1, wherein the second location is a foreign manufacturing facility with respect to the first location.

12. A method for providing a customized lower extremity product, comprising the acts of:

measuring and recording data related to a three-dimensional representation of a customer's lower extremities in an activity-specific optimal stance, at a first location;

transmitting the data to a second location;

manufacturing a customized lower extremity product at the second location, wherein the customized lower extremity product is customized according to the data so as to support the customer's lower extremity in the activity-specific optimal stance; and transferring the customized product to a third location to facilitate customer pickup.

13. The method of claim 12, wherein the three-dimensional representation includes anatomical three-dimensional position information of the lower extremity in the activity-specific optimal stance relative to a supportive surface.

14. The method of claim 12, wherein the act of measuring and recording data related to a three-dimensional representation of a customer's lower extremities in an activity-specific optimal stance, further includes:

positioning the customer's lower extremity in an activity-specific optimal stance; and scanning the customer's lower extremity in an activity-specific optimal stance to produce a three-dimensional representation of the customer's lower extremity in the activity-specific optimal stance.

15. The method of claim 14, wherein the act of positioning the customer's lower extremity in an activity-specific optimal stance includes determining an activity-specific optimal stance which maximizes performance in a particular activity and encouraging a customer's lower extremity into the determined activity-specific optimal stance.

16. The method of claim 12, wherein the three-dimensional representation includes a three-dimensional representation of the sole of the foot in the activity-specific optimal stance.

17. The method of claim 12, wherein the act of transmitting the data to a second location includes transmitting the data across a computer network.

18. The method of claim 12, wherein the act of transferring the customized product to a third location to facilitate customer pickup includes minimizing the distance between the third location and the customer's residence.

19. The method of claim 12, wherein the first location is geographically independent of the second location.

20. The method of claim 12, wherein the first location, second location, and third location are located in substantial proximity to one another.

21. The method of claim 12, wherein the act of transferring the optimized product to a third location to facilitate customer pickup includes shipping the product to an affiliated retail outlet located in substantial proximity to the customer.

22. The method of claim 12, wherein the second location is a foreign manufacturing facility with respect to the first location.

23. A method for providing a customized ski boot, comprising the acts of:

measuring and recording data related to a three-dimensional representation of a customer's lower extremities in an optimal ski stance, at a location in substantial proximity to the customer's residence;

transmitting the data to a second location;

manufacturing a customized lower extremity product at the second location, wherein the customized lower extremity product is customized according to the data so as to support the customer's lower extremity in the activity-specific optimal stance; and transferring the ski boot to a third location to facilitate customer pickup.

* * * * *